US005427499A

United States Patent [19]

Kirby

[11] Patent Number: 5,427,499

[45] Date of Patent: Jun. 27, 1995

[54] TURBINES HAVING DEPRESSIONS IN THE WORKING MEMBERS THEREOF

[76] Inventor: John Kirby, Ramsland Cottage, 75 Ford,, Near Holbeton, Plymouth, Devon, England

[21] Appl. No.: 114,217

[22] Filed: Aug. 30, 1993

[30] Foreign Application Priority Data

Sep. 2, 1992 [GB] United Kingdom ..... 9218544

[51] Int. Cl.[6] ..... F01D 1/36

[52] U.S. Cl. ..... 415/90; 415/206; 241/291; 451/177; 451/259; 451/57; 451/58

[58] Field of Search ..... 415/90, 206; 51/71, 51/109 R, 281 R, 326, 327, 281 SF; 241/291, 293, 296

[56] References Cited

U.S. PATENT DOCUMENTS

| | | | |
|---|---|---|---|
| 2,885,912 | 5/1959 | Alber | 51/327 |
| 3,088,254 | 5/1963 | Lipkins | 51/327 |
| 3,907,456 | 9/1975 | Kienke | 415/90 |
| 5,071,312 | 12/1991 | Kirby | 415/87 |
| 5,240,372 | 8/1993 | Kienke | 415/71 |

FOREIGN PATENT DOCUMENTS

| | | | |
|---|---|---|---|
| 097605 | 1/1984 | European Pat. Off. . | |
| 932653 | 9/1955 | Germany | 51/71 |
| 137548 | 8/1983 | Japan | 51/71 |
| 250207 | 2/1927 | United Kingdom . | |
| 268217 | 3/1927 | United Kingdom . | |
| 387766 | 2/1933 | United Kingdom . | |
| 2095339 | 9/1982 | United Kingdom . | |
| 2221259 | 1/1990 | United Kingdom . | |

*Primary Examiner*—John T. Kwon

*Attorney, Agent, or Firm*—Renner, Otto, Boisselle & Sklar

[57] ABSTRACT

There is disclosed a turbine comprising a pair of relatively movable working members having closely spaced opposed surfaces with depressions therein acting to transer kinetic energy between a working fluid and the working members.

22 Claims, 3 Drawing Sheets

TURBINES HAVING DEPRESSIONS IN THE WORKING MEMBERS THEREOF

This invention relates to turbines.

Turbines, whether used as motors or as pumps, are constructed by attaching vanes or blades to rotary and stationary members, the precise method of attachment and the configuration depending upon the type of turbine—steam, gas or water, axial or radial flow and so on. The manner of construction and the shaping and disposition of the vanes or blades for maximum power output of efficiency combined with the need for reliability in high speed operation, often, especially in the case of gas turbines, at elevated temperatures means that the capital cost of a turbine is high.

The present invention provides turbines of which the capital cost will be low because of the design and construction and the reliability during high speed operation can be increased.

The invention comprises a turbine comprising a pair of relatively movable working members having closely spaced opposed surfaces with depressions therein acting to transer kinetic energy between a working fluid and the working members.

The depressions may be crescent shaped in face view, and may be formed or similar to depressions which are formed by an angled cylindrical rotary cutting tool, which may have a concave end face.

Both members may have depressions.

The depressions, which are easily produced by a machining operation or by a moulding technique, take the place of attached blades, and many different configurations can be envisaged corresponding to the many different configurations of conventional, bladed or vaned turbines.

While the general notion of a turbine is, of course, one involving rotation, it is also possible to conceive of linear turbines, in like manner to the concept of a linear electric motor. Usually, however, the turbine will be rotary.

The members may be relatively rotatable about an axis and the depressions arranged at different radii or axial positions or both on the two members, the depressions on one member overlapping those on the other.

At least one of the members may have depressions at more than one radius. The members may have opposed plane surfaces, or opposed surfaces of solids of revolution—the surfaces may be conical, for example.

Conveniently, one member is fixed while the other rotates.

Working fluid may flow outwardly from the axis of relative rotation. The working fluid may enter axially of one, fixed, member and leave at the outer edge of the space between the surfaces.

A turbine may have members with two or more pairs of opposed surfaces with depressions and may for example comprise a disc with depressions on both faces in a working chamber formed by members with cogenerating faces either side, and a turbine may have a plurality of such discs in such chambers.

The turbine may have a fixed axial delivery duct for working fluid and flow guide means fixed in said duct diverting the axial fluid flow into flow having a radial component.

Embodiments of turbines and methods for making them according to the invention will now be described with reference to the accompanying drawings, in which:

FIGS. 1*a* and 1*b* are face views of a pair of disc members of a first turbine arrangement;

The drawings illustrate turbines comprising a pair of relatively movable working members 11,12 having closely spaced opposed surfaces 11*a*,12*a* with depressions 13 therein acting to transfer kinetic energy between a working fluid 14 and the working members 11,12.

Figure 1A:
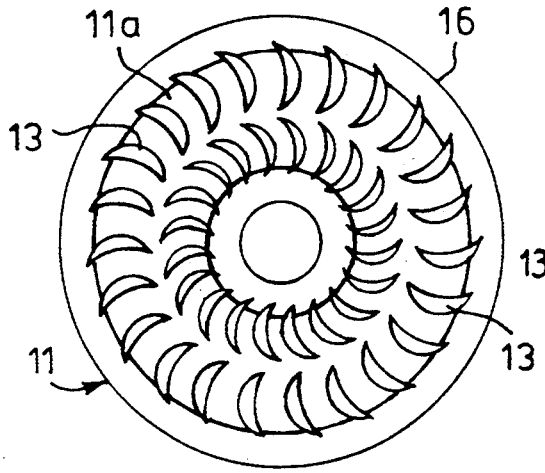
Figure 1B:
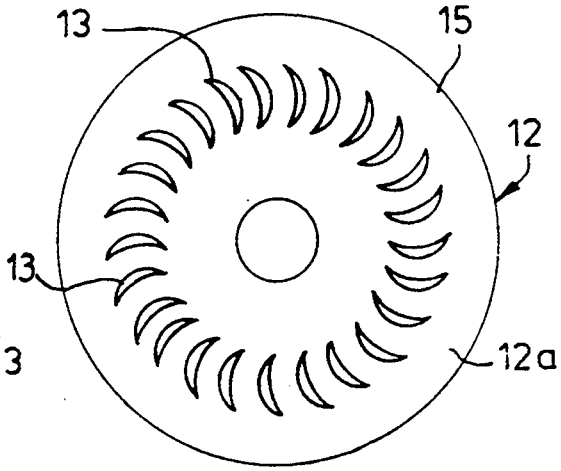
Figure 2:
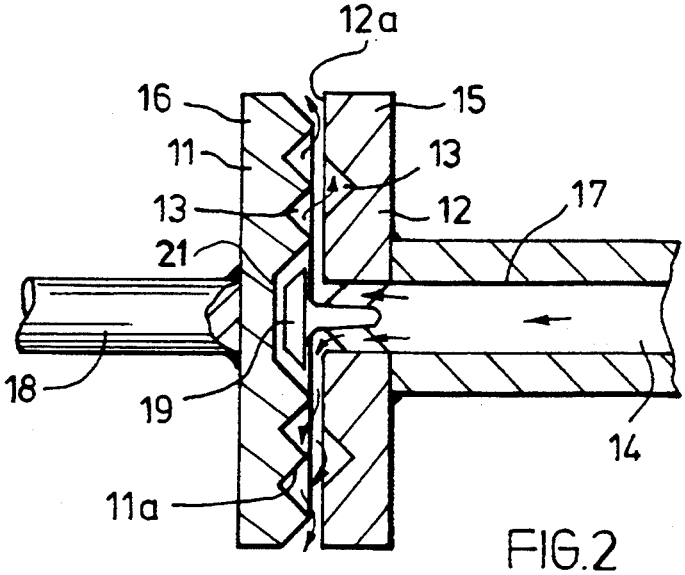
FIG. 2 is an axial section through the two discs and associated shafts when assembled in operative relationship.
Figure 3:
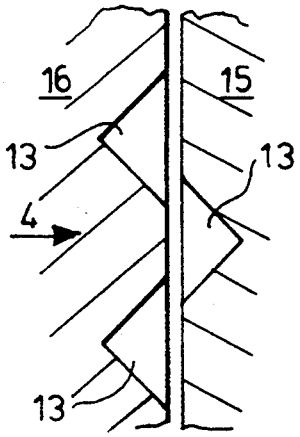
FIG. 3 is a detail from FIG. 2 to a larger scale.
Figure 4:
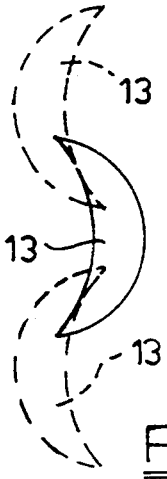
FIG. 4 is a view in the direction of arrow 4 in FIG. 3.

FIGS. 1*a* and 1*b* and 2 illustrate a simple arrangement in which the members 11,12 comprise a fixed disc 15 and a rotary disc 16 having opposed surfaces 11*a*, 12*a* which are planar and uncontoured except for concentric rings or depressions 13 on such surfaces, those on disc 15 being at different radii from those on disc 16 and overlapping as more clearly shown in in FIGS. 3 and 4. In FIG. 4, the depressions of face 11*a* are shown in solid line while those of face 12*a* are shown in broken line.

Figure 7:
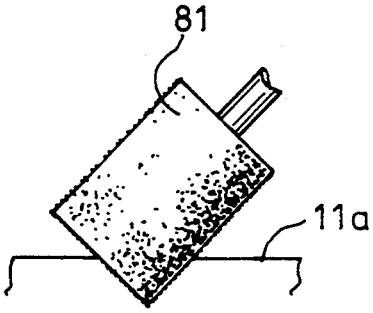
FIG. 7 is a diagrammatic illustration of a first method of cutting the depressions.
Figure 8:
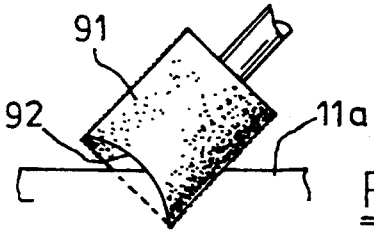
FIG. 8 is an illustration like FIG. 7 of a second method.

FIGS. 7 and 8 illustrate how such depressions 13 may be formed in the discs 15,16 using rotary cutting tools. A cylindrical cutting tool 81 is sunk at an angle of say 45° a little way into the surface 11*a*—this actually produces a half-moon shape as seen face-on, the cutting tool 91 illustrated in FIG. 8, with a concave end face 92 being used to produce the crescent shapes of FIG. 4.

As shown in FIG. 2, fixed disc 15 has a working fluid duct 17 and rotary disc 16 is mounted on a rotary shaft 18 with the faces 11*a*,12*a* in closely spaced arrangement. The duct 17 has a flow diverter 19 attached to it which projects into a recess 21 of the disc 16 and diverts the axial flow of the working fluid into a radial flow between the discs 15,16 without imposing any axial thrust on the disc 16. There will still, of course, be axial thrust on disc 16, but less than if the disc received the full force of the axial flow of working fluid through the duct 17.

The fluid simply flows in a sinuous path, generally radially outwardly from each concentric circle of depressions in one disc to the next in the other.

Of course, the depth, shape and spacing of the depressions can be designed to be different depending on the radius of the circle to optimise performance of the turbine in similar fashion to the way turbine blades and vanes are conventionally arranged from stage to stage of a multi-stage arrangement.

Figure 9:
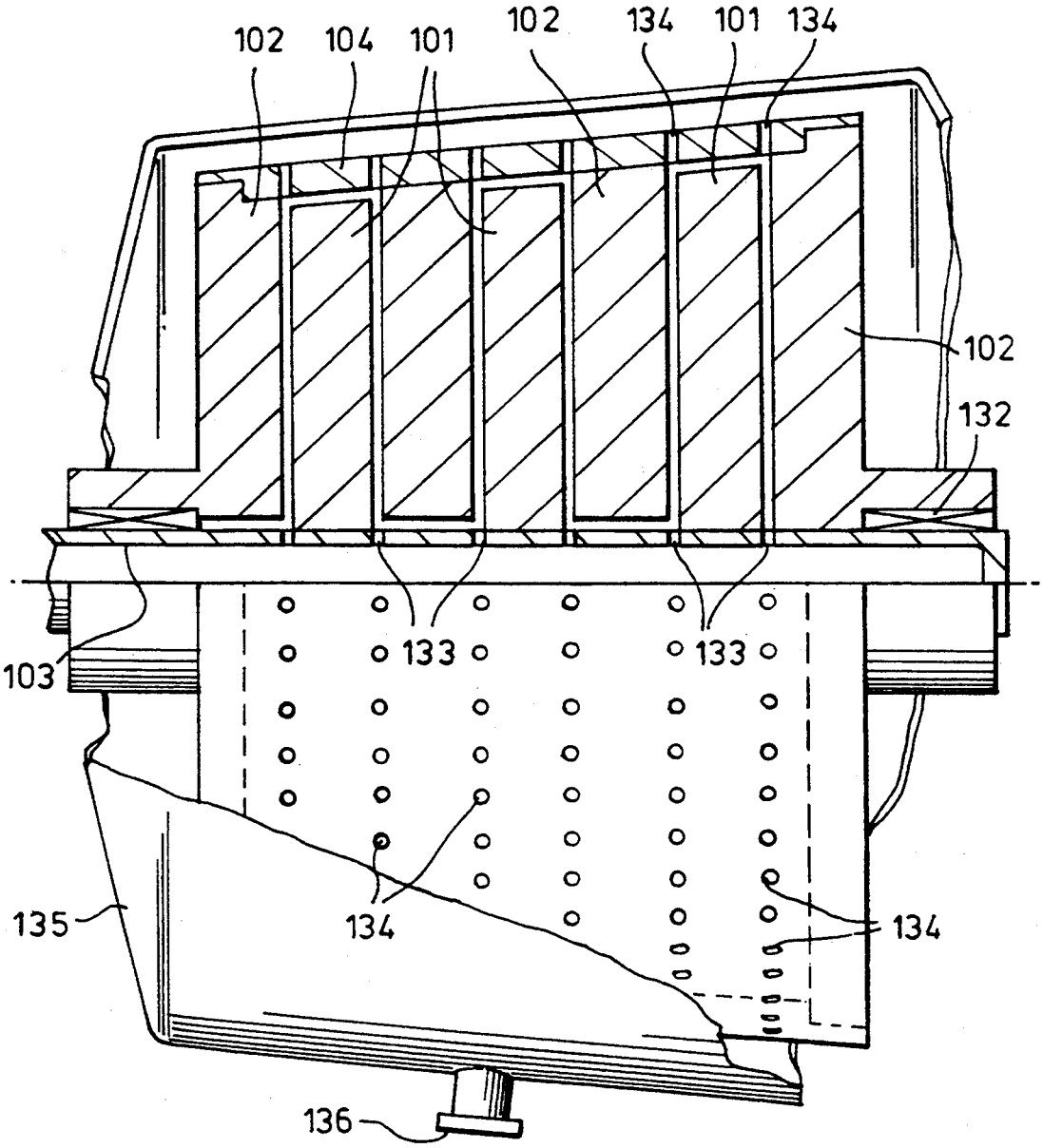
FIG. 9 is an axial part-sectional elevation of another multi-stage embodiment.

FIG. 9 illustrates a multi-stage machine in which discs 101 are mounted on a hollow, stationary shaft 103 and annuli 102 are supported in a rotary casing 104. Working fluid supplied to the hollow shaft 103 flows through apertures 133 between the discs 101 and annuli 102 and exits the casing 104 through further apertures 134. The casing 104 is supported on bearings 132 on the hollow shaft 103 for rotation therabout. The casing 104 is surrounded by an enclosure 135 with an outlet 136 for spent working fluid.

To assemble the arrangement, a disc 101 is pushed along the shaft 103 to a locating position, then an annulus 102 is put in place, followed by another disc 101 and so on until the assembly is complete as illustrated.

Figure 5:
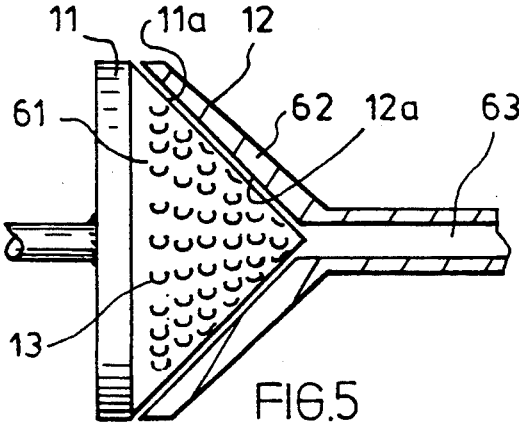
FIG. 5 is an axial section through a conical machine.

Another arrangement is illustrated in FIG. 5, in which the working members 11,12 are shown as having cooperating conical surfaces 11*a*,12*a* which are uncountoured except for the depressions 13 machined or otherwise formed in them. Here, the inner cone 61 is the rotor, and the outer cone 62 is a stator supplying working fluid to the arrangement via a conduit 63.

Figure 6:
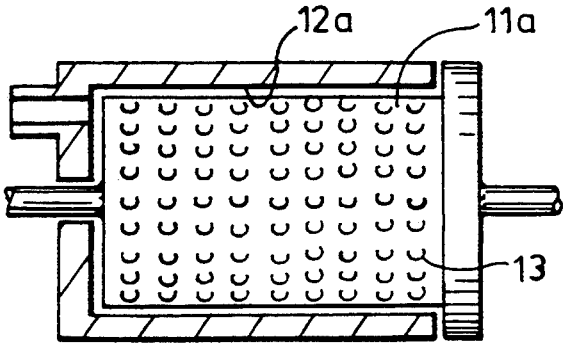
FIG. 6 is an axial section through an axial flow machine.

The arrangement of FIG. 6 is basically similar to that of FIG. 5, except that instead of the configuration being that of a cone, a cylinder arrangement is provided having cooperating cylindrical surfaces 11*a*, 12*a* which are uncountoured except for the circumferential rows of depressions 13 in the cylindrical surfaces 11*a*,12*a*.

The dimensions of the arrangements will depend upon the required power (or, as the case may be, pumping output, it being understood that while the description has been primarily concerned with motors, the devices described and illustrated can also operate, in reverse, as pumps or compressors) but in a typical arrangement with discs 2 cm thick and 40 cm in diameter, the depressions can have a depth of, say, 1 cm.

The spacing of the relatively rotatable members is desirably as close as possible having regard to the fact that actual contact is to be avoided. In the case of purely disc-like members the usual problems of creep and extension under centrifugal stress will be largely avoided since they will not, or not substantially, affect leakage of working fluid nor need large tolerances be required to avoid the risk of high-speed collision.

The principal attraction of the invention is the fact that turbine components can be machined out of solid by a simple technique—once a design has been established even quite rudimentary workshop metalworking tools can be used to make precision components.

Of course, once a design has been established a prototype disc can be used as a form to produce a mould for the mass production of further discs (or, indeed, cones or cylinders or other design of component).

I claim:

1. A turbine comprising a pair of relatively movable working members having closely spaced opposed surfaces with depressions in said surfaces acting to transfer kinetic energy between a working fluid and said members, said members being relatively rotatable about an axis, and said depressions being arranged at different radii on said members, said depressions on one of said members overlapping radially said depressions on the other of said members.

2. A turbine according to claim 1, in which at least one of said members has depressions at more than one radius.

3. A turbine according to claim 1, in which said depressions are crescent-shaped in face view.

4. A turbine according to claim 3, in which said depressions are formed by an angled cylindrical rotary cutting tool.

5. A turbine according to claim 3, in which said depressions are formed by an angled cylindrical rotary cutting tool having a concave end face.

6. A turbine according to claim 1, in which said opposed surfaces are planar except at said depressions.

7. A turbine according to claim 1, in which said opposed surfaces are solids of revolution except at said depressions.

8. A turbine according to claim 7, in which said opposed surfaces are conical except at said depressions.

9. A turbine according to claim 1, in which one of said members is fixed.

10. A turbine according to claim 1, in which said members are relatively rotatable about an axis of relative rotation, and working fluid flows outwardly from said axis of relative rotation.

11. A turbine according to claim 1, in which one of said members is fixed, and working fluid enters axially of said fixed member and leaves at an outer edge of the space between said surfaces.

12. A turbine according to claim 1, having members with two or more pairs of opposed surfaces with depressions.

13. A turbine according to claim 12, comprising a disc with depressions on both faces in a working chamber formed by members with cooperating faces either side.

14. A turbine according to claim 3, in which there are a plurality of said discs in said chamber.

15. A turbine according to claim 1, having a fixed axial delivery duct for working fluid and flow guide means fixed in said duct diverting the axial fluid flow into flow having a radial component.

16. A turbine according to claim 1 in which said opposed surfaces are uncontoured except for said depressions.

17. A turbine according to claim 16, in which said opposed surfaces are planar except at said depressions.

18. A turbine according to claim 16, in which said opposed surfaces are solids of revolution except at said depressions.

19. A turbine according to claim 18, in which said opposed surfaces are conical except at said depressions.

20. A method for making a turbine comprising the steps of providing a pair of relatively movable working members having closely spaced opposed surfaces, said members being relatively rotatable about an axis, and making crescent shaped depressions in said surfaces at different radii on said members with the depressions on one of said members overlapping radially the depressions on the other of said members, said depressions in said surfaces acting to transfer kinetic energy between a working fluid and said members.

21. A method according to claim 20, in which the crescent shaped depressions are made by an angled cylindrical cutting tool.

22. A method according to claim 21, in which the cutting tool has a concave end face.

* * * * *